US011804314B2

(12) United States Patent
Varkey et al.

(10) Patent No.: US 11,804,314 B2
(45) Date of Patent: Oct. 31, 2023

(54) PROCESSES FOR MAKING ELECTRICAL CABLES

(71) Applicant: Schlumberger Technology Corporation, Sugar Land, TX (US)

(72) Inventors: Joseph Varkey, Richmond, TX (US); Willem Wijnberg, Houston, TX (US); Maria Grisanti, Missouri City, TX (US); Paul Wanjau, Missouri City, TX (US); Douglas Pipchuk, London (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 52 days.

(21) Appl. No.: 17/164,373

(22) Filed: Feb. 1, 2021

(65) Prior Publication Data

US 2021/0158991 A1 May 27, 2021

Related U.S. Application Data

(62) Division of application No. 15/612,179, filed on Jun. 2, 2017, now abandoned.

(51) Int. Cl.
*H01B 13/26* (2006.01)
*H01B 7/04* (2006.01)
(Continued)

(52) U.S. Cl.
CPC ..... *H01B 7/046* (2013.01); *H01B 13/22* (2013.01); *H01B 13/26* (2013.01);
(Continued)

(58) Field of Classification Search
CPC ..... H01B 7/046; H01B 13/22; H01B 13/26; H01B 13/2646; H01B 7/428; H01B 13/2633; Y10T 29/49194; G02B 6/4427
(Continued)

(56) References Cited

U.S. PATENT DOCUMENTS 3,681,510 A 8/1972 Lemieux
4,214,693 A 7/1980 Smith
(Continued)

FOREIGN PATENT DOCUMENTS

DE 4209928 C1 12/1992
EP 1094194 A2 4/2001
(Continued)

OTHER PUBLICATIONS

Definition of "serrated" from www.dictionary.reference.com, Jan. 15, 2016, 1 page.
(Continued)

*Primary Examiner* — Donghai D Nguyen

(57) ABSTRACT

Electrical cables and processes for making and using same. In some examples, the electrical cable can include one or more insulated electrical conductors and one or more metallic elements cabled together and a metallic layer disposed about the one or more insulated electrical conductors and the one or more metallic elements. The one or more metallic elements can partially fill a space located between the one or more insulated electrical conductors and the metallic layer. The one or more insulated electrical conductors can each include an electrically conductive core, a layer of electrically insulating material disposed about the electrically conductive core, and a layer of metallic strands disposed about the layer of electrically insulating material.

8 Claims, 6 Drawing Sheets

(51) Int. Cl.
*H01B 13/22* (2006.01)
*H01B 7/42* (2006.01)

(52) U.S. Cl.
CPC ..... *H01B 13/2646* (2013.01); *H01B 7/428* (2013.01); *H01B 13/2633* (2013.01); *Y10T 29/49194* (2015.01)

(58) Field of Classification Search
USPC ..... 29/868
See application file for complete search history.

(56) References Cited

U.S. PATENT DOCUMENTS

| | | | | |
|---|---|---|---|---|
| 4,847,448 | A | 7/1989 | Sato | |
| 5,121,872 | A | 6/1992 | Legget | |
| 5,122,209 | A | 6/1992 | Moore et al. | |
| 5,191,173 | A | 3/1993 | Sizer et al. | |
| 5,210,377 | A | 5/1993 | Kennedy et al. | |
| 5,216,204 | A | 6/1993 | Dudek et al. | |
| 5,269,377 | A | 12/1993 | Martin | |
| 5,949,018 | A | 9/1999 | Esker | |
| 6,246,006 | B1 | 6/2001 | Hardin et al. | |
| 6,392,151 | B1 | 5/2002 | Rafie et al. | |
| 6,815,617 | B1 | 11/2004 | Gebs et al. | |
| 6,924,436 | B2 | 8/2005 | Varkey et al. | |
| 7,009,113 | B2 | 3/2006 | Varkey | |
| 7,158,703 | B2 * | 1/2007 | Mjelstad | G02B 6/4427 385/101 |
| 8,008,577 | B2 * | 8/2011 | Lima | H01B 7/0072 174/103 |
| 9,069,148 | B2 | 6/2015 | Herbst | |
| 9,627,100 | B2 | 4/2017 | Pourladian et al. | |
| 9,725,997 | B2 * | 8/2017 | Pinkston | E21B 17/206 |
| 2003/0037927 | A1 | 2/2003 | Dalrymple et al. | |
| 2007/0000682 | A1 | 1/2007 | Varkey et al. | |
| 2010/0263904 | A1 | 10/2010 | Varkey et al. | |
| 2011/0005795 | A1 | 1/2011 | Deighton et al. | |
| 2014/0102749 | A1 | 4/2014 | Varkey | |
| 2015/0034358 | A1 | 2/2015 | Armbrecht et al. | |

FOREIGN PATENT DOCUMENTS

| | | |
|---|---|---|
| GB | 2321128 A | 7/1998 |
| WO | 201206350 | 7/1998 |

OTHER PUBLICATIONS

Definition of "serrated" from www.thefreedictionary.com, Jan. 15, 2016, 2 pages.

* cited by examiner

PROCESSES FOR MAKING ELECTRICAL CABLES

BACKGROUND

Field

Embodiments described generally relate to electrical cables and processes for making and using same.

Description of the Related Art

Electric submersible pump cable designs typically include three copper conductors cabled together, with each conductor including a layer of polymeric insulation and an optional semi-conductive layer disposed thereabout. A filler material fills interstitial spaces between the cabled conductors and a polymeric jacket is extruded over the cabled copper conductors to produce a jacketed core. An outer metal layer is often applied about the jacketed core and seam welded to provide an outer metal layer that increases the strength of the cable and provides protection to the jacketed core. One difficulty encountered during manufacture of the cable is that the polymeric jacket, filler material, and/or polymeric insulation can be burned when the outer metal layer is seam welded thereabout.

One solution to the above issue is to dispose an interlocking tape around the polymeric jacket to protect the polymeric jacket during seam welding of the metal layer. The interlocking tape acts as a coupling point between the outer metal layer and the jacketed core, but also imposes radial stresses on the jacketed core and the metal cladding when the cable is bent, which causes the fatigue life of the cable to be reduced. The interlocking tape also increases the diameter and weight of the cable without providing any additional strength.

There is a need, therefore, for cables having reduced manufacturing issues.

SUMMARY

Electrical cables and processes for making and using same are provided. In some examples, the electrical cable can include three insulated electrical conductors and metallic elements cabled together and a metallic layer disposed about the three insulated electrical conductors and the metallic elements. The metallic elements can partially fill an interstitial space located between the three insulated electrical conductors and the metallic layer. The three insulated electrical conductors can each include an electrically conductive core, a layer of electrically insulating material disposed about the electrically conductive core, and a layer of metallic strands disposed about the layer of electrically insulating material.

In some examples; a process for making a cable, can include cabling three insulated electrical conductors and metallic elements together and seam welding a metallic layer about the three insulated electrical conductors and the metallic elements. The metallic elements can partially fill an interstitial space located between the three insulated electrical conductors and the metallic layer. The three insulated electrical conductors can each include an electrically conductive core, a layer of electrically insulating material disposed about the electrically conductive core, and a layer of metallic strands disposed about the layer of electrically insulating material. The process can also include drawing down the metallic layer about the three insulated electrical conductors and the metallic elements to produce an electrical cable.

In some examples, an electrical cable can be connected to a wellbore tool to provide electrical power to the wellbore tool. The electrical cable can include three insulated electrical conductors and metallic elements cabled together and a metallic layer disposed about the three insulated electrical conductors and the metallic elements. The metallic elements can partially fill an interstitial space located between the three insulated electrical conductors and the metallic layer. The three insulated electrical conductors can each include an electrically conductive core, a layer of electrically insulating material disposed about the electrically conductive core, and a layer of metallic strands disposed about the layer of electrically insulating material. In some examples, at least two of the electrically conductive cores can be electrically connected to the wellbore tool such that an electric current can flow from the electrical cable to the wellbore tool.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Figure 1:
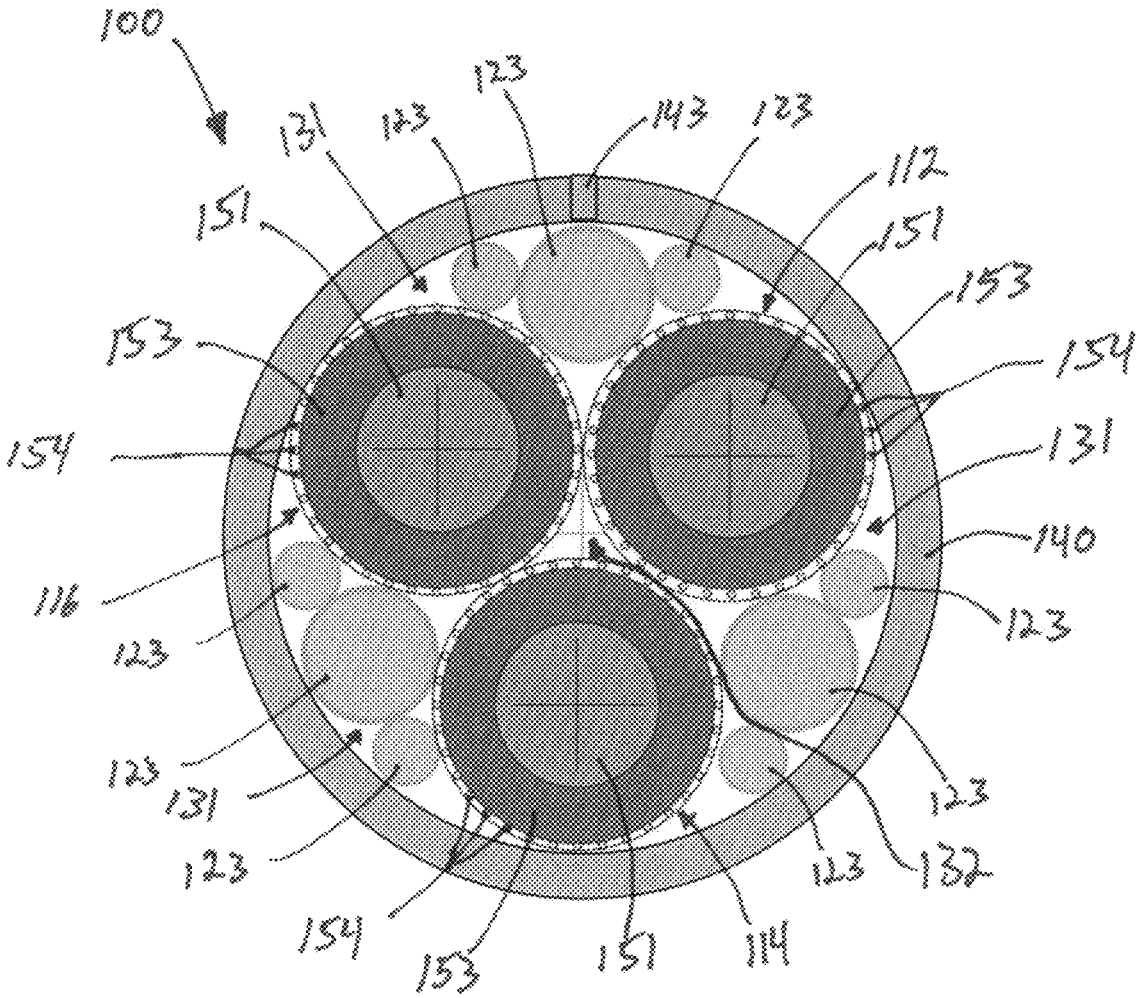
FIG. 1 depicts an end view of an illustrative electrical cable that includes metallic elements partially occupying an interstitial space located between insulated electrical conductors cabled together and a metallic layer disposed thereabout, the insulated electrical conductors including an electrically conductive core, a layer of electrically insulating material, and a layer of metallic strands, according to one or more embodiments described.
Figure 2:
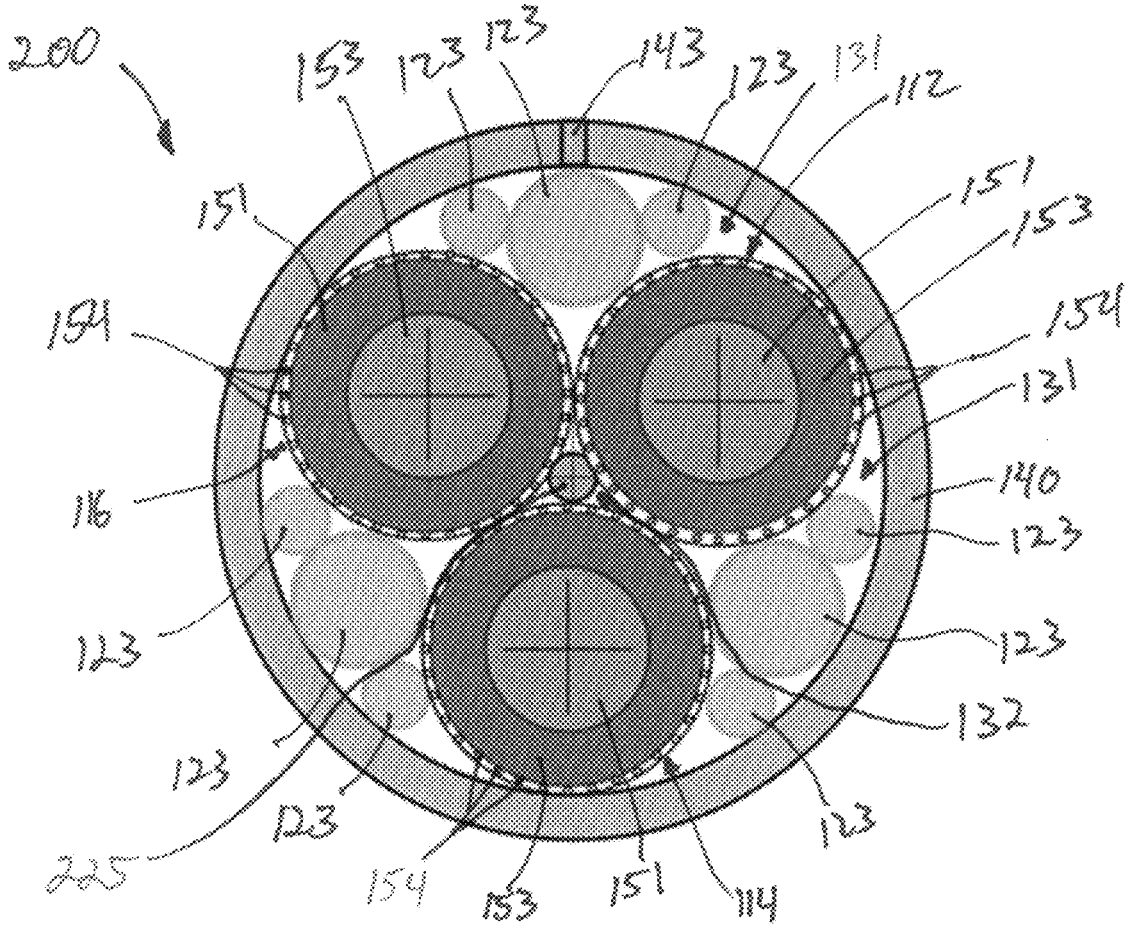
FIG. 2 depicts an end view of an illustrative electrical cable that includes metallic elements partially occupying an interstitial space located between insulated electrical conductors cabled together and a metallic layer disposed thereabout and a core element occupying a portion of a central interstitial space located between the insulated electrical conductors, according to one or more embodiments described.

FIG. 1 depicts an end view of an illustrative electrical cable 100 that includes one or more metallic elements 123 (nine are shown) partially occupying an area or space, e.g., an interstitial space, 131 located between one or more insulated electrical conductors (three are shown: 112, 114, 116) cabled together and a metallic layer 140 disposed thereabout, according to one or more embodiments. FIG. 2 depicts an end view of an illustrative electrical cable 200 that includes one or more metallic elements 123 (nine are shown) partially occupying the area or space, e.g., interstitial space, 131 located between the two or more insulated electrical conductors (three are shown: 112, 114, 116) cabled together and a metallic layer 140 disposed thereabout and one or more core elements 225 (one is shown) partially occupying an interstitial space 132 located between the insulated electrical conductors 112, 114, 116, according to one or more embodiments. In some examples, the core element 225 can partially or completely occupy or fill the interstitial space 132 located between the insulated electrical conductors 112, 114, 116 cabled together. As such, in some examples, the insulated electrical conductors 112, 114, and 116 can be cabled together and the metallic elements 123 can partially occupy or partially fill the interstitial space 131 between the insulated electrical conductors 112, 114, 116 and the metallic layer 140 and the core element 225 can partially or completely occupy or fill the interstitial space 132 between the insulated electrical conductors 112, 114, and 116. The electrical cables 100, 200 can include any number of insulated electrical conductors, metallic elements, and core elements. In some examples, the electrical cables 100, 200 can include about 1, about 2, about 3, about 4, or about 5 to about 6, about 7, about 8, about 9, or about 10, or more of the insulated electrical conductors. In some examples, the electrical cables 100, 200 can include about 1, about 2, about 3, about 6, or about 9 to about 15, about 20, about 25, about 30, about 35, about 40, about 45, about 50, or more of the metallic elements. In some examples the electrical cables 100, 200 can include about 1, about 2, or about 3 to about 5, about 7, or about 10, or more of the core elements.

In some examples, the portion of the interstitial space 131 that can be unoccupied or unfilled by the metallic elements 123 and/or the portion of the interstitial space 132 that can be unoccupied or unfilled by the core element 225 can permit a fluid to flow through the electrical cables 100, 200. As such, during or after manufacture of the electrical cables 100, 200, the cables 100, 200 can be pressure tested. Pressure testing the electrical cables 100, 200 can be used to determine if the metallic layer 140 has a defect, e.g., pinhole and/or crack. If the pressure testing identifies a defect, the defect can be repaired prior to completing manufacture of the electrical cables 100, 200 or after manufacture of the cables 100, 200. In some examples, pressure testing the electrical cables 100, 200 can include introducing a fluid into the open interstitial space 131 and/or 132 therein at an elevated pressure and the electrical cables 100, 200 can be monitored to see if the pressure decreases over time, which can be an indication of a defect in the metallic layer 140. The fluid used to pressure test the cables 100, 200 can be or include, but is not limited to, air, nitrogen, helium, other gases, water, hydraulic fluid, other liquids, or mixtures thereof. During pressure testing of the electrical cables 100, 200, the pressure can be greater than atmospheric pressure. For example, the pressure can be about 102 kPa, about 110 kPa, about 50 kPa, about 100 kPa, about 200 kPa, or about 300 kPa to about 500 kPa, about 700 kPa, about 1,000 kPa or greater.

The insulated electrical conductors 112, 114, 116 can each be or include an electrically conductive core 151 and one or more layers of an electrically insulating material 153 disposed about the electrically conductive core 151. The electrically conductive core 151 can be or include, but is not limited to, a metal, an electrically conductive polymer, or a combination thereof. In some examples, the electrically conductive core 151 can be or include, but is not limited to, copper, aluminum, silver, gold, tin, lead, zinc, phosphorus, alloys thereof, or any combination thereof. In other examples, the electrically conductive core 151 can be or include copper, aluminum, copper-clad aluminum, silver-clad aluminum, silver-clad copper, steel, or phosphor bronze. In some examples, the electrically conductive core 151 can be or include, but is not limited to, electrically conducting polymers or co-polymers such as polyacetylene (PA), polypyrrole (PPY), poly (phenylacetylene) (PPA), poly (p-phenylene sulphide) (PPS), poly (p-phenylene) (PPP), polythiophene (PTP), polyfuran (PFU), polyaniline (PAN), polyisothianaphthene (PIN), fluorinated polyacetylenes, halogen and cyano substituted polyacetylenes, alkoxy-substituted poly (p-phenylenevinylene), poly (5,6-dithiooctyl isothianaphthene, anilne copolymers containing butylthio substituent, butylthioaniline copolymers, cyano-substituted distyryl benzenes, poly (fluorenebenzothiadiazsole-cyanophenylenevinylene), other polymers and/or copolymers, or any combination thereof. The electrically conductive core 151 can be a solid core or can be composed of a plurality of strands, e.g., a plurality of metallic wires or a plurality of electrically conductive polymer fibers.

The layer of electrically insulating material 153 can prevent or at least partially isolate any electricity conducted through the electrically conductive core 151 from passing therethrough. The layer of electrically insulating material 153 can be or include, but is not limited to, one or more thermoset polymers, one or more thermoplastic polymers, paper, fiberglass, or combinations thereof. In some examples, the layer of electrically insulating material 153 can be or include, but is not limited to, polyethylene, polyurethane, rubber, crosslinked polyethylene, polyvinyl chloride, polytetrafluoroethylene, ethylene tetrafluoroethylene, tetrafluoroethylene, fluorinated ethylene propylene, a polyimide, oil impregnated paper, modified ethylene tetrafluoroethylene, cresyl phthalate, wax, polyetherketone (PEK), polyether ether ketone (PEEK), polyaryletherketone (PAEK), or any combination thereof. Illustrative rubber can be or include, but is not limited to, thermoplastic rubber, neoprene (polychloroprene), styrene butadiene rubber (SBR), silicone, natural rubber, ethylene propylene diene monomer (EPDM), ethylene propylene rubber (EPR), chlorosulfonated polyethylene (CSPE), other thermoset rubber, any other type of rubber, or any combination thereof.

One or more of the insulated electrical conductors 112, 114, 116 can also include metallic strands 154 that can be disposed about the layer of electrically insulating material 153. The metallic strands 154 can be disposed about the layer of electrically insulating material 153 via any desired process and can have any desired configuration with respect to one another. For example, the metallic strands 154 can be served, braided, or otherwise disposed about the layer of electrically insulating material 153. In some examples, the metallic strands 154 can be served about the layer of electrically insulating material 153 by helically wrapping the strands about the outside of and along a longitudinal axis of the layer of electrically insulating material 153. In other examples, the metallic strands 154 can be braided about the layer of electrically insulating material 153 by forming helical interlocking spirals of the metallic strands 154 about the outside of and along a longitudinal axis of the electrical insulating layer 153.

In some examples, a single layer of metallic strands 154 can be served or braided about the layer of electrically insulating material 153. In other examples two, three, four, or more layers of metallic strands 154 can be served or braided about the layer of electrically insulating material 153. If two or more layers of metallic strands 154 are present, each layer of metallic strands 154 can be served or braided in either the same helical direction or in a contra-helical direction with respect to one another. In at least one example, two layers of the metallic strands 154 can be contrahelically served or braided about the layer of electrically insulating material 153. The metallic strands 154 can be or include, but are not limited to, copper, aluminum, silver, gold, tin, lead, zinc, phosphorus, alloys thereof, or any combination thereof. For example, the metallic strands can be or include copper, aluminum, copper-clad aluminum, silver-clad aluminum, silver-clad copper, galvanized steel, or phosphor bronze.

The metallic layer 140 can be disposed about the insulated electrical conductors 112, 114, 116, the metallic elements 123, and, if present, the core element 225 cabled together. In some examples, the metallic layer 140 can be a metal substrate, e.g., a metal sheet or foil, disposed about the insulated electrical conductors 112, 114, 116, the metallic elements 123, and, if present, the core element 225 cabled together and can be welded along a seam 143. In other examples, the metallic layer 140 can be a metallic tube (with a seam or without a seam) and the insulated electrical conductors 112, 114, 116, the metallic elements 123, and, if present, the core element 225 cabled together can be placed within the metallic tube.

In some examples, with the metallic layer 140 disposed about the insulated electrical conductors 112, 114, 116, the metallic elements 123, and, if present, the core element 225 cabled together the metallic layer 140 can be compressed thereabout to couple the metallic layer 140 to the insulated electrical conductors 112, 114, 116, the metallic elements 123, and the core element 225 cabled together. For example, the metallic layer 140 can be rolled to draw down the metallic layer 140 about the insulated electrical conductors 112, 114, 116, the metallic elements 123, and the core element 225 cabled together. In another example, the metallic layer 140 can be pulled through a die to draw down the metallic layer 140 about the insulated electrical conductors 112, 114, 116, the metallic elements 123, and the core element 225 cabled together.

In some examples, the metallic layer 140 can be in direct contact with at least one of the metallic elements 123 and the layer of metallic strands 154 of the insulated electrical conductors 112, 114, 116. In other examples, the metallic layer 140 can be in direct contact with the metallic elements 123 and a gap can be present between the metallic layer 140 and the layer of metallic strands 154 of the insulated electrical conductors 112, 114, 116. In other examples, the metallic layer 140 can be in direct contact with the layer of metallic strands 154 of the insulated electrical conductors 112, 114, 116 and a gap can be present between the metallic layer 140 and the metallic elements 123.

The metallic layer 140 can be or include, but is not limited to, copper, aluminum, austenitic nickel-chromium based alloys, nickel-iron-chromium based alloys, stainless steel, carbon steel, alloys thereof, or any combination thereof. Some commercially available metal alloys the metallic layer 140 can be made of can include, but are not limited to, INCONEL® nickel-chromium alloy 625 and INCOLOY® nickel-iron-chromium alloy 825. In some examples, the metallic layer 140 can formed from corrosion resistant metal. In other examples, the metallic layer 140 can be formed from carbon steel.

The metallic layer 140 can serve as or otherwise provide a barrier or protection layer to the insulated electrical conductors 112, 114, 116 and metallic elements 123, and if present core element 225 cabled together and disposed therein. For example, the metallic layer 140 can prevent fluid, e.g., a downhole fluid, from coming into contact with the insulated electrical conductor 112, 114, 116 when the electrical cable 100 and/or 200 is located in a downhole environment.

The metallic elements 123 can be or include, but are not limited to, foamed metallic rods, stranded electrical conductors, hollow rods or tubes, metallic elements having a cross-sectional shape that can correspond to or substantially corresponding to a cross-sectional shape of the interstitial spaces 131 and/or 132, or any combination thereof. The metallic elements 123 can be made of or otherwise include any suitable metal, metal alloy, or combinations thereof. For example, the metallic elements 123 can be made of or include aluminum, copper, titanium, manganese, stainless steel, carbon steel, nickel, chromium, iron, combinations thereof, or any alloy thereof. In some examples, the metallic elements 123 can be aluminum, copper-clad aluminum, titanium, or a combination thereof.

The core element 225 can be or include, but is not limited to, one or more fiber optic cables, foamed metallic rods, stranded electrical conductors, hollow rods or tubes, or any combination thereof. When the core element 225 includes a metallic component the metallic component can be or include any one or more of the metals or alloys that the metallic elements 123 can be or include. If the core element 225 includes a fiber optic cable, the fiber optic cable can be used for telemetry with a downhole electrical submersible pump and/or to monitor real time distributed temperature, strain, and/or vibration in the cable 100. In some examples, the core elements 123 can be or include foamed metallic rods, stranded electrical conductors, hollow rods or tubes, or any combination thereof and the core element 225 can be or include a fiber optic cable.

Figure 3:
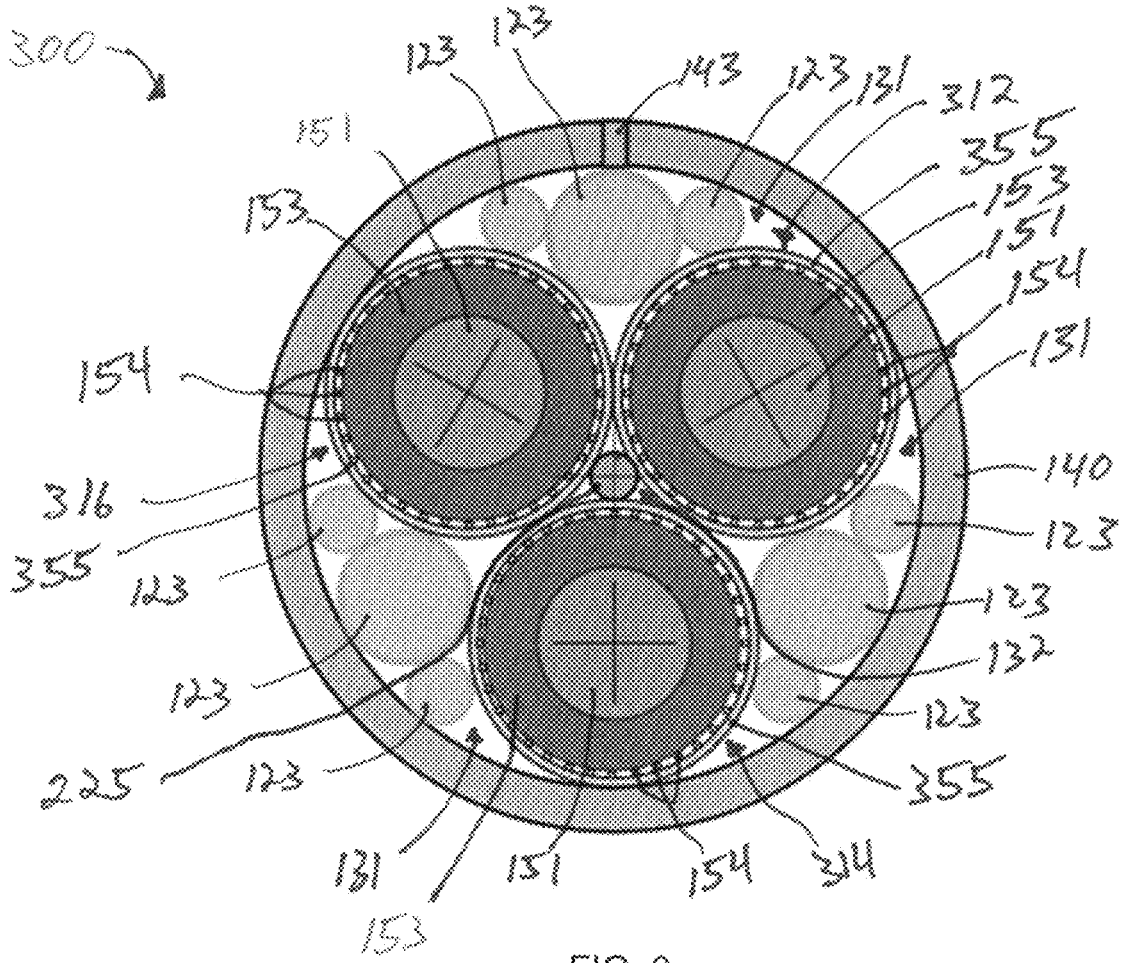
FIG. 3 depicts an end view of another illustrative electrical cable that includes metallic elements partially occupying an interstitial space located between insulated electrical conductors cabled together and a metallic layer disposed thereabout, the insulated electrical conductors including an electrically conductive core, a layer of electrically insulating material, a layer of metallic strands, and a metallic sleeve disposed about the layer of metallic strands, according to one or more embodiments described.

FIG. 3 depicts an end view of another illustrative electrical cable 300 that includes metallic elements (nine are shown) 123 partially occupying the area or space, e.g., interstitial space, 131 located between insulated electrical conductors (three are shown: 312, 314, 316) cabled together and a metallic layer 140 disposed thereabout, the insulated electrical conductors 312, 314, 316 including the core 151, the layer of insulating material 153, the layer of metallic strands 154, and a metallic sleeve 355 disposed about the layer of metallic strands 154, according to one or more embodiments. In some examples, one or more metallic layers or sleeves 355 can be disposed about at least one of the layers of metallic strands 154 of the insulated electrical conductors 312, 314, 316. In some examples, the metallic sleeve 355 can be disposed about the metallic strands 154 by introducing an assembly of the electrically conductive core 151, the layer of electrically insulating material 153, and the layer of metallic strands 154 into the metallic sleeve 355. In other examples, the metallic sleeve 355 can be placed around the metallic strands 154 and welded along a seam similar to one of the processes that can be used to secure the metallic layer 140 about the insulated electrical conductors 112, 114, 116 and metallic elements 123 cabled together discussed and described above with reference to FIG. 1.

In some examples, the metallic sleeve 355 can be rolled or otherwise compressed around the metallic strands 154. In other examples, the metallic sleeve 355 can be pulled through a die to draw down the metallic sleeve 355 around the metallic strands 154. In some examples, the metallic sleeve 355 can be a metal strip formed into a tube and welded along a seam. In other examples, the metallic sleeve can be a seamless tube. The metallic sleeve 355 can be or include, but is not limited to, copper, aluminum, austenitic nickel-chromium based alloys, nickel-iron-chromium based alloys, stainless steel, carbon steel, alloys thereof, or any combination thereof. Some commercially available metal alloys the metallic sleeve 355 can be made of can include, but are not limited to, INCONEL® nickel-chromium alloy 625 and INCOLOY® nickel-iron-chromium alloy 825.

In some examples, the metallic layer 140 can be in direct contact with at least one of the metallic elements 123 and the metallic sleeve 355 of the insulated electrical conductors 312, 314, 316. In other examples, the metallic layer 140 can be in direct contact with the metallic elements 123 and a gap can be present between the metallic sleeve 355 and the layer of metallic strands 154 of the insulated electrical conductors 312, 314, 316. In other examples, the metallic layer 140 can be in direct contact with the metallic sleeve 355 of the insulated electrical conductors 312, 314, 316 and a gap can be present between the metallic layer 140 and the metallic elements 123.

The electrical cable 300 including the metallic layer 140 and the metallic sleeve 355 can be referred to as an electrical cable 300 having dual barriers or dual protection layers. For example, the metallic layer 140 can be referred to as a first or primary barrier or protection layer and the metallic sleeve 355 can referred to as a second or secondary barrier or protection layer. Should the metallic layer 140 fail for some reason the metallic sleeve 140 can prevent fluid, e.g., a downhole fluid, from coming into contact with the layer of metallic strands 154, the layer of electrically insulating material 153, and the electrically conducting core 151 disposed therein.

Figure 4:
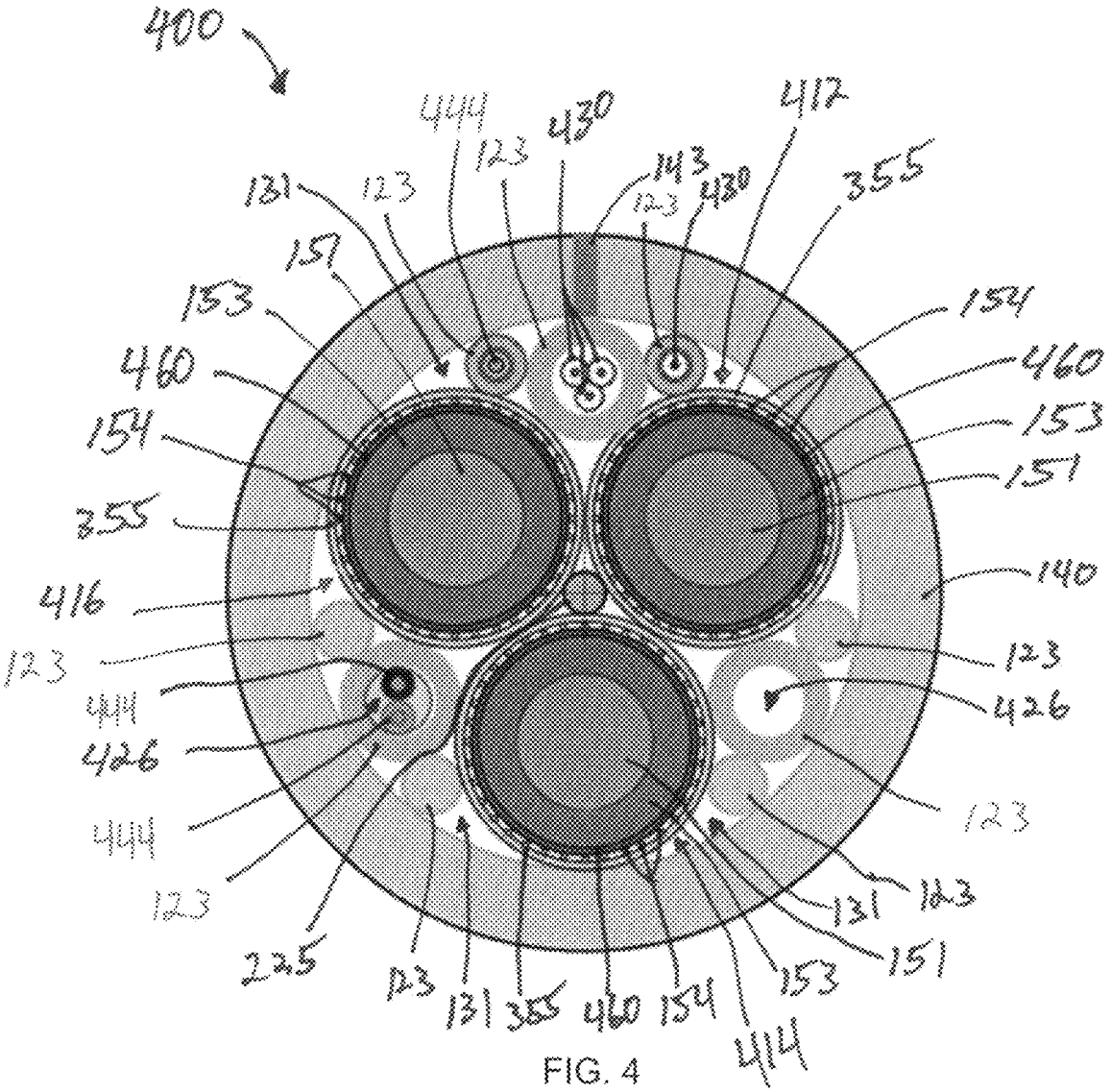
FIG. 4 depicts an end view of yet another illustrative electrical cable that includes metallic elements partially occupying an interstitial space located between insulated electrical conductors cabled together and a metallic layer disposed thereabout, the insulated electrical conductors including an electrically conductive core, a layer of electrically insulating material, a layer of a polymer material, a layer of metallic strands, and a metallic sleeve disposed about the layer of metallic strands, according to one or more embodiments described.

FIG. 4 depicts an end view of another illustrative electrical cable 400 that includes metallic elements 123 (nine are shown) partially occupying the area or space, e.g., interstitial space, 131 located between the insulated electrical conductors (three are shown: 412, 414, 416) cabled together and the metallic layer 140 disposed thereabout, the insulated electrical conductors 412, 414, 416 including the electrically conducting core 151, the layer of insulating material 153, a layer of a polymer material 460, the layer of metallic strands 154, and the metallic sleeve 355 disposed about the layer of metallic strands 154, according to one or more embodiments. As such, the layer of polymer material 460 can be disposed between the layer of electrically insulating material 153 and the metallic strands 154. In some examples, the layer of polymer material 460 can be disposed about the electrically insulated layer 153 of at least one of the insulated electrical conductors 412, 414, 416.

In some examples, the polymer material 460 can reduce or eliminate stress that may be directed toward the layer of electrically insulating material 153 by the layer of metallic strands 154. In some examples, the polymer material 460 can reinforce the insulated electrical conductor 412, 414, 416 and/or reduce the likelihood of or prevent the layer of electrically insulating material 153 from failing during use of the electrical cable 400, e.g., during temperature and/or pressure cycles.

The polymer material 460 can be or include one or more electrically non-conductive polymers, one or more electrically conductive polymers, one or more electrically semi-conductive polymers, or combinations thereof. The polymer material 460 can be or include one or more thermoset polymers, one or more thermoplastic polymers, or a combination thereof. In some examples, the polymer material 460 can be or include, but is not limited to, polyethylene, polyurethane, rubber, crosslinked polyethylene, polyvinyl chloride, polytetrafluoroethylene, ethylene tetrafluoroethylene, tetrafluoroethylene, fluorinated ethylene propylene, a polyimide, modified ethylene tetrafluoroethylene, cresyl phthalate, wax, polyetherketone (PEK), polyether ether ketone (PEEK), polyaryletherketone (PAEK), polyacetylene (PA), polypyrrole (PPY), poly (phenylacetylene) (PPA), poly (p-phenylene sulphide) (PPS), poly (p-phenylene) (PPP), polythiophene (PTP), polyfuran (PFU), polyaniline (PAN), polyisothianaphthene (PIN), fluorinated polyacetylenes, halogen and cyano substituted polyacetylenes, alkoxy-substituted poly (p-phenylenevinylene), poly (5,6-dithiooctyl isothianaphthene, anilne copolymers containing butylthio substituent, butylthioaniline copolymers, cyano-substituted distyryl benzenes, poly (fluorenebenzothiadiazsole-cyanophenylenevinylene), other polymers and/or copolymers, or any combination thereof. Illustrative rubber can be or include, but is not limited to, thermoplastic rubber, neoprene (polychloroprene), styrene butadiene rubber (SBR), silicone, natural rubber, ethylene propylene diene monomer (EPDM), ethylene propylene rubber (EPR), chlorosulfonated polyethylene (CSPE), other thermoset rubber, or any other type of rubber.

In some examples, if one or more of the metallic elements 123 include a bore or other passageway therethrough or therein 426, one or more additional apparatus or fluids can be disposed therein. For example, if one or more of the metallic elements 123 include a bore 426 therethrough, one or more optical fibers 430, one or more insulated conductors 444, or other apparatus can be disposed therein. In another example, the bore 426 can be configured to convey one or more fluids, e.g., a hydraulic fluid, the metallic element 123.

Figure 5:
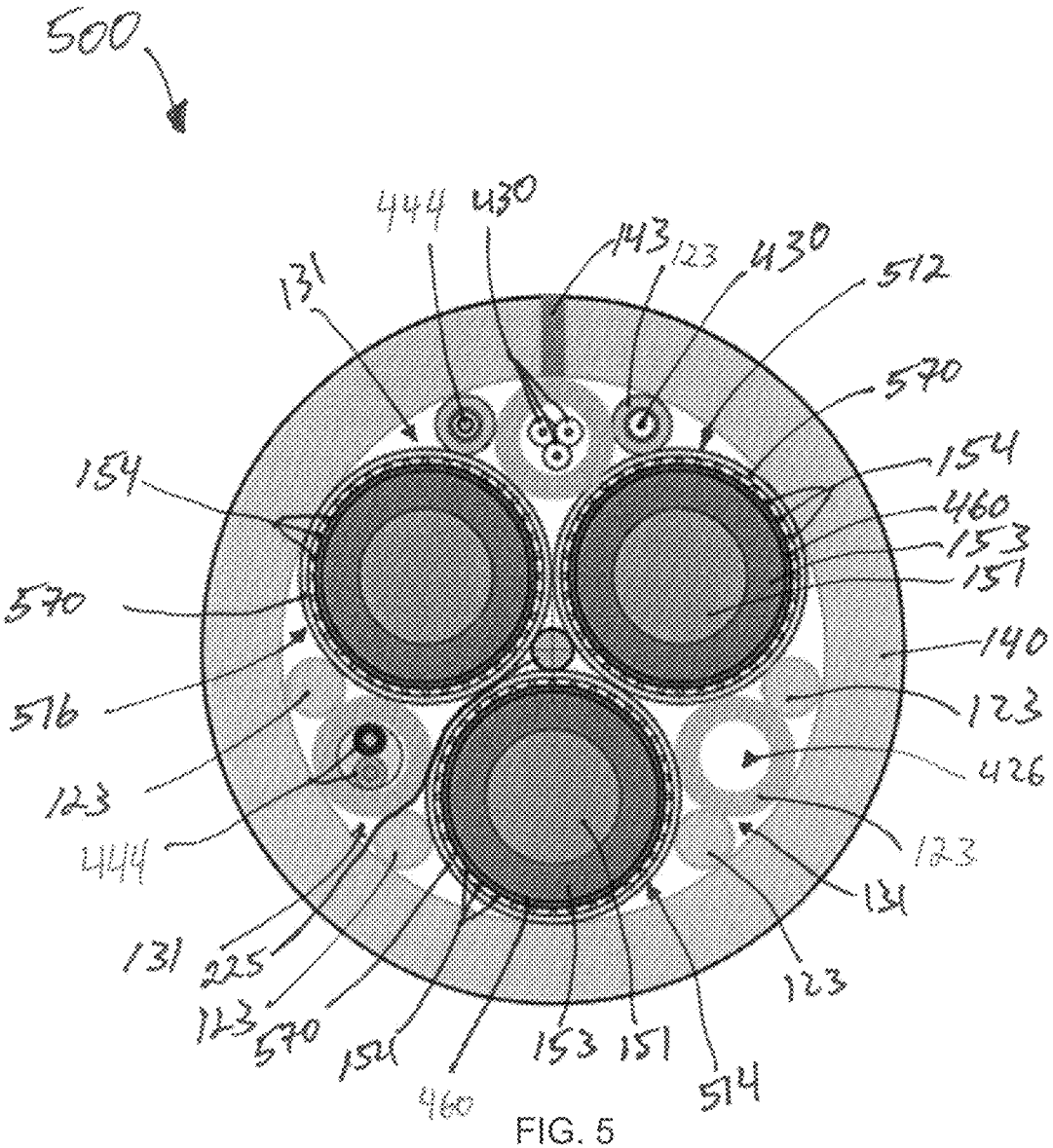
FIG. 5 depicts an end view of another illustrative electrical cable that includes metallic elements partially occupying an interstitial space located between insulated electrical conductors cabled together and a metallic layer disposed thereabout, the insulated electrical conductors including an electrically conductive core, a layer of electrically insulating material, a layer of a polymer material, a layer of metallic strands, and a heat diffusing tape disposed about the layer of metallic strands, according to one or more embodiments described.

FIG. 5 depicts an end view of another illustrative electrical cable 500 that includes metallic elements 123 (nine are shown) partially occupying the area or space, e.g., interstitial space, 131 between insulated electrical conductors (three are shown: 512, 514, 516) cabled together and the metallic layer 140 disposed thereabout, the insulated electrical conductors 512, 514, 516 including the electrically conducting core 151, the layer of electrically insulating material 153, the layer of polymer material 460, the layer of metallic strands 154, and a heat diffusing tape 570 disposed about the layer of metallic strands 154, according to one or more embodiments. In some examples, a layer of heat diffusing tape 570 can be disposed about the metallic strands 154 of at least one of the insulated electrical conductors 512, 514, 516. In some examples, the layer of the heat diffusing tape 570 can be provided by wrapping the heat diffusing tape 570 about the metallic strands 154. As such, the layer of the heat diffusing tape 570 can be disposed between the metallic strands 154 and the metallic layer 140 disposed about the insulated electrical conductors 512, 514, 516, the metallic elements 123, and, if present, the core element 225 cabled together.

The heat diffusing tape 570 can be a tape made of or including one or more metals. For example, the heat diffusing tape 570 can be or include a tape made from copper, aluminum, austenitic nickel-chromium based alloys, nickel-iron-chromium based alloys, stainless steel, carbon steel, alloys thereof, or any combination thereof. Some commercially available metal alloys the heat diffusing tape 570 can be made of can include, but are not limited to, INCONEL® nickel-chromium alloy 625 and INCOLOY® nickel-iron-chromium alloy 825. In some examples, the heat diffusing tape 570 can help protect the layer of metallic strands 154, the layer of polymer material 460, the layer of electrically insulating material 153, and the electrically conducting core 151 disposed therein from weld heat generated during installation of the metallic layer 140, if the metallic layer includes a weld seam 143.

In some examples, the metallic layer 140 can be in direct contact with at least one of the metallic elements 123 and the layer of heat diffusing tape 570 of the insulated electrical conductors 512, 514, 516. In other examples, the metallic layer 140 can be in direct contact with the metallic elements 123 and a gap can be present between the metallic layer 140 and the layer of heat diffusing tape 570 of the insulated electrical conductors 512, 514, 516. In other examples, the metallic layer 140 can be in direct contact with the layer of heat diffusing tape 570 of the insulated electrical conductors 512, 514, 516 and a gap can be present between the metallic layer 140 and the metallic elements 123.

In some examples, one or more of the insulated electrical conductors 512, 514, 516 can further include a metallic sleeve, e.g., the metallic sleeve 355 discussed and described above with reference to FIG. 3, disposed about the layer of heat diffusing tape 570. In some examples, the metallic layer 140 can be in direct contact with at least one of the metallic elements 123 and the metallic sleeve disposed about the layer of heat diffusing tape 570 of the insulated electrical conductors 512, 514, 516. In other examples, the metallic layer 140 can be in direct contact with the metallic elements 123 and a gap can be present between the metallic layer 140 and the metallic sleeve disposed about the layer of heat diffusing tape 570 of the insulated electrical conductors 512, 514, 516. In other examples, the metallic layer 140 can be in direct contact with the metallic sleeve disposed about the layer of heat diffusing tape 570 of the insulated electrical conductors 512, 514, 516 and a gap can be present between the metallic layer 140 and the metallic elements 123.

Figure 6:
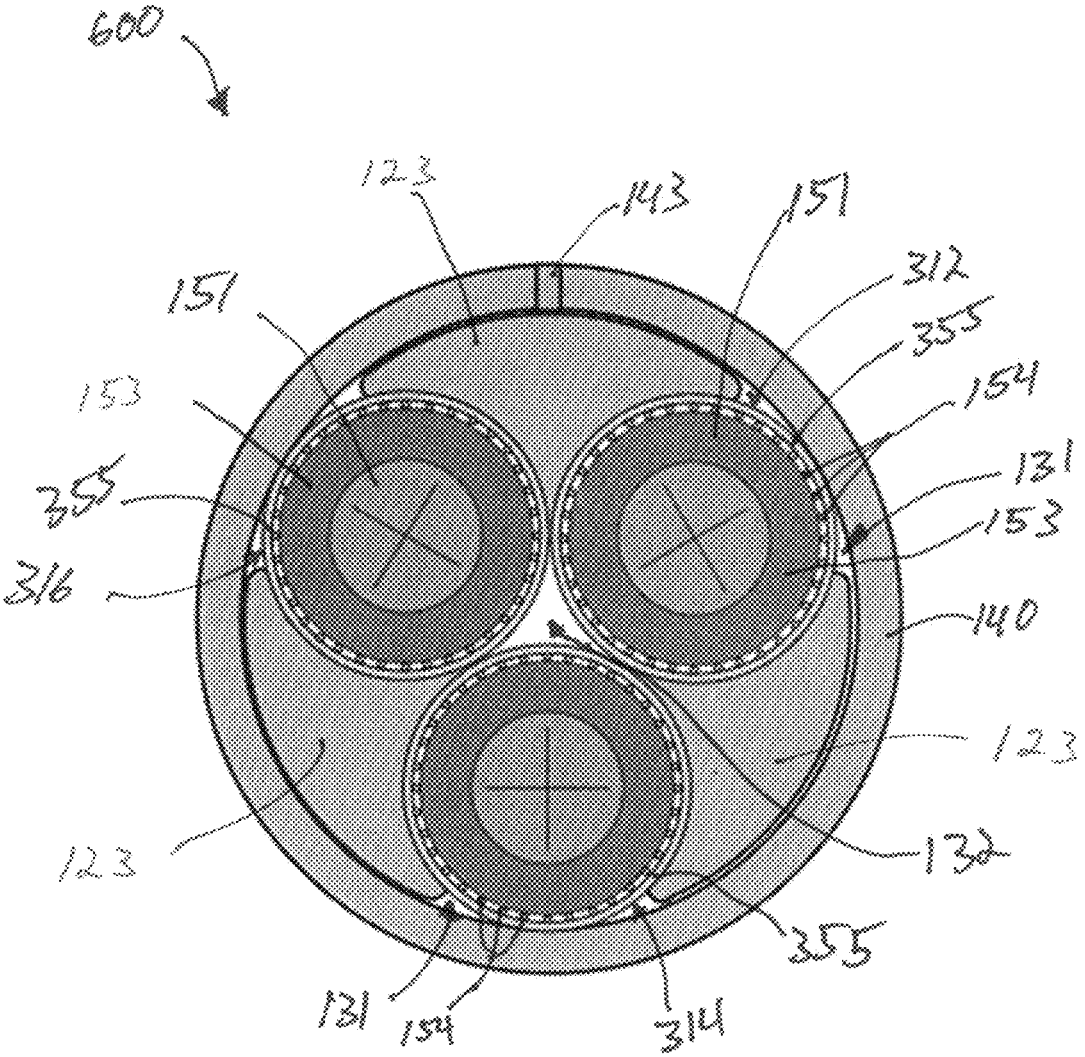
FIG. 6 depicts an end view of yet another illustrative electrical cable that includes metallic elements partially occupying an interstitial space located between insulated electrical conductors cabled together and a metallic layer disposed thereabout, where the metallic elements have a cross-sectional shape that substantially corresponds to a cross-sectional shape of the interstitial space, according to one or more embodiments described.

FIG. 6 depicts an end view of yet another illustrative electrical cable 600 that includes metallic elements 123 (three are shown) partially occupying the area or space, e.g., interstitial space, 131 located between the insulated electrical conductors 312, 314, 316 and the metallic layer 140 disposed thereabout, where the metallic elements 123 have a cross-sectional shape that substantially corresponds to a cross-sectional shape of the interstitial space 131, according to one or more embodiments. As shown, the metallic elements 123 can have a shape similar to and occupying a portion of the interstitial space 131 located between two of the insulated electrical conductors 312, 314, or 316. In some examples, the metallic elements 123 can completely occupy the interstitial space 131 and the interstitial space 132 can remain at least partially open or otherwise unoccupied by any core element, e.g., the core element 225 discussed and described above with reference to FIG. 2.

The insulated electrical conductors, metallic elements and, if present, core element(s) in the cables 100, 200, 300, 400, 500, and/or 600 can be cabled together via any desired cabling machine or by hand. In some examples a tubular or planetary type cabling machine can be used. The cabling machine can wrap the metallic elements, the insulated electric conductors, and, if present, the core element(s) while introducing little to no residual twist. In some examples, the cabling machine can adjust the lay angles of the metallic elements and the insulated electrical conductors prior to or during cabling to tune the flexibility and fatigue resistance of the cable 100, 200, 300, 400, 500 and/or 600. In some examples, if present, the core element can be positioned at a zero lay angle, while the metallic elements and the insulated electrical conductors can be helically positioned around the core element 225 at predetermined lay angles to produce a cable 100, 200, 300, 400, 500 and/or 600 that can have a desired flexibility and/or fatigue resistance.

In some examples, the electrical cables 100, 200, 300, 400, 500, and/or 600 can be connected to a wellbore tool, not shown, and can provide electrical power and/or hydraulic control to the tool or can serve as an umbilical. In some examples, at least two of the electrically conducting cores 151 of the electrical cables 100, 200, 300, 400, 500, and/or 600 can be electrically connected to the wellbore tool such that an electric current can flow from the electrical cable to the wellbore tool. In other examples, the three electrically conducting cores 151 of the electrical cables 100, 200, 300, 400, 500, and/or 600 can be electrically connected to the wellbore tool such that an electric current can flow from the electrical cable to the wellbore tool. In other examples, the number of electrically conducting cores 151 that can be electrically connected to the wellbore tool can be 4, 5, 6, 7, 8, 9, 10, or more and can depend, at least in part, on the electrical demand of a given wellbore tool and on the number of electrically conducting cores 151 in a given electrical cable. The wellbore tool can include one or more electric submersible pumps, one or more combinable seismic imager tools, one or more motors, one or more well logging tools, or any other downhole instrument that may be electrically powered.

In some examples, the electrical cables 100, 200, 300, 400, 500, and/or 600 can be connected to a wellbore tool or any other device via a connector or coupling that can utilize metal to metal seals. For example, a tube fitting that includes a two-ferrule mechanical grip design in which the ferrules separate sealing and tube gripping functions can be used. For example, a front or first ferrule can provide or create a seal against the fitting body and an outside diameter of the metallic layer 140 and a back or second ferrule can axially advance the front ferrule as the nut is turned and can radially apply an effective grip about the cable.

It should be noted that any one of more of the insulated electrical conductors 112, 114, 116, 312, 314, 316, 412, 414, 416, 512, 514, and 516 can have any desired configuration of materials disposed about the layer of electrically insulating material 153 that can be disposed about the electrically conducting core 151. For ease of description the layers of the insulated electrical conductors can be expressed in a simplified format with the electrically conducting core 151 represented as ECC, the layer of electrically insulating material 153 represented as EIM, the layer of metallic strands 154 represented as MS, the layer of polymer material 460 represented as PM, the metallic sleeve 355 represented as MSLV, the layer of heat diffusing tape 570 represented as HDT. An insulated electrical conductor including the electrically conducting core 151, the layer of electrically insulating material 153, and the metallic strands 154 can be expressed or described as ECC/EIM/MS. Other configurations that any one or more of the insulated electrical conductors 112, 114, 116, 312, 314, 316, 412, 414, 416, 512, 514, and 516 can have can include, but are not limited to, ECC/EIM/MS/MSLV; ECC/EIM/MS/HDT/MSLV; ECC/EIM/PM/MS; ECC/EIM/PM/MS/HDT; ECC/EIM/PM/MS/MSLV; ECC/EIM/PM/MS/HDT/MSLV; ECC/EIM/HDT/MS; ECC/EIM/HDT/MS/MSLV; ECC/EIM/PM/HDT/MS; ECC/EIM/PM/HDT/MS/MSLV; or any other desired configuration.

It should also be understood that any one or more of the electrical cables 100, 200, 300, 400, 500, and/or 600 can include any combination of insulated electrical conductors 112, 114, 116, 312, 314, 316, 412, 414, 416, 512, 514, and 516. For example, an electrical cable can include at least one insulated electrical conductor 112 and at least one insulated electrical conductor 312. In another example, an electrical cable can include at least one insulated electrical conductor 312 and at least one insulated electrical conductor 412. In another example, an electrical cable can include at least one insulated electrical conductor 412 and at least one insulated electrical conductor 512.

Electrical cables that include 1, 2, 3, 4, 5, 6, or more insulated electrical conductors, e.g., 112, 114, 116, 312, 314, 316, 412, 414, 416, 512, 514, and 516, can be produced by cabling one or more insulated electrical conductors and one or more metallic elements together, seam welding a metallic layer about the one or more insulated electrical conductors and the one or more metallic elements; and drawing down the metallic layer about the one or more insulated electrical conductors and the one or more metallic elements. For example, the electrical cables 100, 200, 300, 400, 500, and/or 600 can be produced by cabling three or more insulated electrical conductors and the metallic elements together, seam welding a metallic layer about the three insulated electrical conductors and the metallic elements; and drawing down the metallic layer about the three insulated electrical conductors and the metallic elements. If the cable includes a single insulated electrical conductor such as a coaxial cable, the metallic elements can partially fill an annular space located between the insulated electrical conductor and the metallic layer disposed about the insulated electrical conductor and the metallic elements. In some examples, the metallic elements can partially fill an interstitial space located between two or more insulated electrical conductors and the metallic layer disposed thereabout. In another example, the metallic elements can partially fill an interstitial space located between three insulated electrical conductors and the metallic layer.

In some examples, the insulated electrical conductors can include an electrically conductive core, a layer of electrically insulating material disposed about the electrically conductive core, and a layer of metallic strands disposed about the layer of electrically insulating material. In other examples, the insulated electrical conductors can include an electrically conductive core, a layer of electrically insulating material disposed about the electrically conductive core, a layer of metallic strands disposed about the layer of electrically insulating material, and a metallic sleeve disposed about the metallic strands. In other examples, the insulated electrical conductors can include an electrically conductive core, a layer of electrically insulated material disposed about the electrically conductive core, a layer of metallic strands disposed about the layer of electrically insulating material, and a layer of heat diffusing tape disposed about the metallic strands. In other examples, the insulated electrical conductors can include an electrically conductive core, a layer of electrically insulated material disposed about the electrically conductive core, a layer of metallic strands disposed about the layer of electrically insulating material, a layer of heat diffusing tape disposed about the metallic strands, and a metallic sleeve disposed about the metallic strands. In other examples, the insulated electrical conductors can include an electrically conductive core, a layer of electrically insulating material disposed about the electrically conductive core, a layer of a polymer material disposed about the layer of electrically insulating material, and a layer of metallic strands disposed about the layer of polymer material. In some examples, the insulated electrical conductors can include an electrically conductive core, a layer of electrically insulating material disposed about the electrically conductive core, a layer of polymer material disposed about the layer of electrically insulating material, a layer of metallic strands disposed about the layer of polymer material, and a metallic sleeve disposed about the layer of metallic strands. In some examples, the insulated electrical conductors can include an electrically conductive core, a layer of electrically insulating material disposed about the electrically conductive core, a layer of polymer material disposed about the layer of electrically insulating material, a layer of metallic strands disposed about the layer of polymer material, a layer of heat diffusing tape disposed about the layer of metallic strands, and a metallic sleeve disposed about the layer of heat diffusing tape. In some examples, the insulated electrical conductors can include an electrically conductive core, a layer of electrically insulating material disposed about the electrically conductive core, a layer of polymer material disposed about the layer of electrically insulating material, a layer of metallic strands disposed about the layer of polymer material, and a layer of heat diffusing tape disposed about the layer of metallic strands.

It should be noted that electrical cables can include a single insulated electrical conductor cabled with the metallic elements 123 and can also include the metallic layer 140 disposed thereabout, where the metallic elements 123 partially fill an area or space located between the insulated electrical conductor and the metallic layer 140. For example, any one of the insulated electrical conductors 112, 114, 116, 312, 314, 316, 412, 414, 416, 512, 514, or 516 and the metallic elements 123 can be cabled together and the metallic layer 140 can be disposed thereabout to provide a cable that includes a single electrical conductor. It should also be noted that electrical cables can also include two insulated electrical conductors, i.e., greater than one insulated electrical conductor and less than three insulated electrical conductors, cabled with the metallic elements 123 and can also include the metallic layer 140 disposed thereabout, where the metallic elements 123 partially fill the area or space, e.g., an interstitial space, located between the two insulated electrical conductors and the metallic layer 140. For example, any two of the insulated electrical conductors 112, 114, 116, 312, 314, 316, 412, 414, 416, 512, 514, and 516 and metallic elements 123 can be cabled together and the metallic layer 140 can be disposed thereabout to provide a cable that includes two insulated electrical conductors, i.e., greater than one insulated electrical conductor and less than three insulated electrical conductors.

In some examples, if the electrical cable includes a single insulated electrical conductor or two insulated electrical conductors the area or space between the single insulated electrical conductor or the two insulated electrical conductors and the metallic layer 140 can permit a fluid to flow through the electrical cable. As such, cables including a single insulated electrical conductor or two insulated electrical conductors can be pressure tested during and/or after manufacture thereof. Pressure testing can be used to determine if the metallic layer 140 has a defect, e.g., pinhole and/or crack. If the pressure testing identifies a defect, the defect can be repaired prior to completing manufacture of the electrical cables or after manufacture of the cables.

Embodiments of the present disclosure further relate to any one or more of the following examples:

1. An electrical cable, comprising: three insulated electrical conductors and metallic elements cabled together; and a metallic layer disposed about the three insulated electrical conductors and the metallic elements, wherein the metallic elements partially fill an interstitial space located between the three insulated electrical conductors and the metallic layer, and wherein the three insulated electrical conductors each comprise: an electrically conductive core; a layer of electrically insulating material disposed about the electrically conductive core; and a layer of metallic strands disposed about the layer of electrically insulating material.

2. An electrical cable, comprising: three insulated electrical conductors cabled together; metallic elements partially filling an interstitial space between the three insulated electrical conductors; and a metallic layer disposed about the three insulated electrical conductors and the metallic elements, wherein the three insulated electrical conductors each comprise: an electrically conductive core; a layer of electrically insulating material disposed about the electrically conductive core; and a layer of metallic strands disposed about the layer of electrically insulating material.

3. A process for making a cable, comprising: cabling three insulated electrical conductors and metallic elements together; seam welding a metallic layer about the three insulated electrical conductors and the metallic elements, wherein the metallic elements partially fill an interstitial space located between the three insulated electrical conductors and the metallic layer, and wherein the three insulated electrical conductors each comprise: an electrically conductive core; a layer of electrically insulating material disposed about the electrically conductive core; and a layer of metallic strands disposed about the layer of electrically insulating material; and drawing down the metallic layer about the three insulated electrical conductors and the metallic elements to produce an electrical cable.

4. A process for making an electrical cable, comprising: cabling three insulated electrical conductors and metallic elements together, wherein the metallic elements partially fill interstitial spaces between the three insulated electrical conductors, wherein the three insulated electrical conductors each comprise: an electrically conductive core; a layer of electrically insulating material disposed about the electrically conductive core; and a layer of metallic strands disposed about the layer of electrically insulating material; seam welding a metallic layer about the three insulated electrical conductors and the metallic elements; and drawing down the metallic layer about the three insulated electrical conductors and the metallic elements 5. An electrical cable connected to a wellbore tool for providing electrical power to the wellbore tool, comprising: three insulated electrical conductors and metallic elements cabled together; and a metallic layer disposed about the three insulated electrical conductors and the metallic elements, wherein the metallic elements partially fill an interstitial space located between the three insulated electrical conductors and the metallic layer, and wherein the three insulated electrical conductors each comprise: an electrically conductive core; a layer of electrically insulating material disposed about the electrically conductive core; and a layer of metallic strands disposed about the layer of electrically insulating material; and wherein at least two of the electrically conductive cores are electrically connected to the wellbore tool such that an electric current can flow from the electrical cable to the wellbore tool.

6. An electrical cable connected to a wellbore tool for providing electrical power to the tool, comprising: three insulated electrical conductors cabled together; metallic elements partially filling an interstitial space between the three insulated electrical conductors; and a metallic layer disposed about the three insulated electrical conductors and the metallic elements, wherein the three insulated electrical conductors each comprise: an electrically conductive core; a layer of electrically insulating material disposed about the electrically conductive core; and a layer of metallic strands disposed about the layer of electrically insulating material; and at least two of the electrical conductors are electrically connected to the wellbore tool such that an electric current can flow from the electrical conductors to the wellbore tool.

7. The electrical cable or process according to any one of examples 1 to 6, wherein the metallic strands are served or braided about the layer of electrically insulating material.

8. The electrical cable or process according to any one of examples 1 to 7, wherein each layer of metallic strands is in direct contact with the metallic layer.

9. The electrical cable or process according to any one of examples 1 to 7, wherein each layer of metallic strands is in direct contact with at least one of the metallic elements.

10. The electrical cable or process according to any one of examples 1 to 7, wherein each layer of metallic strands is in direct contact with the metallic layer and at least one of the metallic elements.

11. The electrical cable or process according to any one of examples 1 to 7, wherein at least one of the three insulated electrical conductors further comprises a layer of heat diffusing tape disposed about the layer of metallic strands.

12. The electrical cable or process according to examples 11, wherein the layer of heat diffusing tape is in direct contact with the metallic layer.

13. The electrical cable or process according to examples 11, wherein the layer of heat diffusing tape is in direct contact with at least one of the metallic elements.

14. The electrical cable or process according to examples 11, wherein the layer of heat diffusing tape is in direct contact with the metallic strands and the metallic layer.

15. The electrical cable or process according to examples 11, wherein the layer of heat diffusing tape is in direct contact with the metallic strands, the metallic layer, and at least one of the metallic elements.

16. The electrical cable or process according to any one of examples 1 to 7, wherein at least one of the three insulated electrical conductors further comprises a metallic sleeve disposed about the metallic strands.

17. The electrical cable or process according to examples 16, wherein the metallic sleeve is in direct contact with the metallic layer.

18. The electrical cable or process according to examples 16, wherein the metallic sleeve is in direct contact with at least one of the metallic elements.

19. The electrical cable or process according to examples 16, wherein the metallic sleeve is in direct contact with the metallic strands and the metallic layer.

20. The electrical cable or process according to examples 16, wherein the metallic sleeve is in direct contact with the metallic strands, the metallic layer, and at least one of the metallic elements.

21. The electrical cable or process according to any one of examples 16 to 20, further comprising a layer of heat diffusing tape disposed between the metallic strands and the metallic sleeve.

22. The electrical cable or process according to any one of examples 1 to 21, wherein at least one of the three insulated electrical conductors further comprises a layer of polymer material disposed between the layer of electrically insulating material and the layer of metallic strands.

23. The electrical cable or process according to examples 22, wherein the layer of polymer material comprises a thermoset polymer, a thermoplastic polymer, or a combination thereof.

24. The electrical cable or process according to examples 22, wherein the layer of polymer material comprises polyethylene, polyurethane, rubber, crosslinked polyethylene, polyvinyl chloride, polytetrafluoroethylene, ethylene tetrafluoroethylene, tetrafluoroethylene, fluorinated ethylene propylene, a polyimide, modified ethylene tetrafluoroethylene, cresyl phthalate, wax, a polyetherketone, a polyether ether ketone, a polyaryletherketone, or a combination thereof.

25. The electrical cable or process according to examples 22, wherein the layer of polymer material comprises a rubber, and wherein the rubber comprises a thermoplastic rubber, neoprene, styrene butadiene rubber, silicone, natural rubber, ethylene propylene diene monomer, ethylene propylene rubber, chlorosulfonated polyethylene, or a combination thereof.

26. The electrical cable or process according to examples 22, wherein the layer of polymer material comprises an electrically semiconductive polymer, an electrically conductive polymer, an electrically non-conductive polymer, or any combination thereof.

27. The electrical cable or process according to examples 22, wherein the layer of polymer material comprises an electrically semiconductive polymer.

28. The electrical cable or process according to examples 22, wherein the layer of polymer material comprises an electrically conductive polymer.

29. The electrical cable or process according to examples 22, wherein the layer of polymer material comprises an electrically non-conductive polymer.

30. The electrical cable or process according to any one of examples 1 to 7, wherein at least one of the three insulated electrical conductors further comprises a layer of polymer material disposed between the layer of electrically insulating material and the layer of metallic strands and a layer of heat diffusing tape disposed about the layer of metallic strands, and wherein the layer of heat diffusing tape is in direct contact with the metallic layer.

31. The electrical cable or process according to any one of examples 1 to 7, wherein at least one of the three insulated electrical conductors further comprises a layer of polymer material disposed between the layer of electrically insulating material and the layer of metallic strands and a layer of heat diffusing tape disposed about the layer of metallic strands, and wherein the layer of heat diffusing tape is in direct contact with at least one of the metallic elements.

32. The electrical cable or process according to any one of examples 1 to 7, wherein at least one of the three insulated electrical conductors further comprises a layer of polymer material disposed between the layer of electrically insulating material and the layer of metallic strands and a layer of heat diffusing tape disposed about the layer of metallic strands, and wherein the layer of heat diffusing tape is in direct contact with the metallic layer and at least one of the metallic elements.

33. The electrical cable or process according to any one of examples 1 to 7, wherein at least one of the three insulated electrical conductors further comprises a layer of polymer material disposed between the layer of electrically insulating material and the layer of metallic strands and a layer of heat diffusing tape disposed about the layer of metallic strands, and wherein the layer of heat diffusing tape is in direct contact with the metallic strands, the metallic layer, and at least one of the metallic elements.

34. The electrical cable or process according to any one of examples 1 to 7, wherein at least one of the three insulated electrical conductors further comprises a layer of polymer material disposed between the layer of electrically insulating material and the layer of metallic strands and a metallic sleeve disposed about the layer of metallic strands, and wherein the metallic sleeve is in direct contact with the metallic layer.

35. The electrical cable or process according to any one of examples 1 to 7, wherein at least one of the three insulated electrical conductors further comprises a layer of polymer material disposed between the layer of electrically insulating material and the layer of metallic strands and a metallic sleeve disposed about the layer of metallic strands, and wherein the metallic sleeve is in direct contact with at least one of the metallic elements.

36. The electrical cable or process according to any one of examples 1 to 7, wherein at least one of the three insulated electrical conductors further comprises a layer of polymer material disposed between the layer of electrically insulating material and the layer of metallic strands and a metallic sleeve disposed about the layer of metallic strands, and wherein the metallic sleeve is in direct contact with the metallic layer and at least one of the metallic elements.

37. The electrical cable or process according to any one of examples 1 to 7, wherein at least one of the three insulated electrical conductors further comprises a layer of polymer material disposed between the layer of electrically insulating material and the layer of metallic strands and a metallic sleeve disposed about the layer of metallic strands, and wherein the metallic sleeve is in direct contact with the metallic strands, the metallic layer, and at least one of the metallic elements.

38. The electrical cable or process according to any one of examples 1 to 37, wherein the metallic strands are contra-helically served about the layer of electrically insulating material.

39. The electrical cable or process according to any one of examples 1 to 38, wherein the metallic layer is formed from a strip of corrosion resistant metal.

40. The electrical cable or process according to any one of examples 1 to 38, wherein the metallic layer is formed from a strip of carbon steel.

41. The electrical cable or process according to any one of examples 1 to 40, wherein an unfilled interstitial space permits a fluid to flow through the electrical cable.

42. The electrical cable or process according to any one of examples 1 to 40, wherein the interstitial space unfilled by the metallic elements permits a fluid to flow through the electrical cable.

43. The electrical cable or process according to any one of examples 1 to 40, wherein the interstitial space located between the three insulated electrical conductors and the metallic layer that is unfilled by the metallic elements permits a fluid to flow through the electrical cable.

44. The electrical cable or process according to any one of examples 1 to 40, wherein an interstitial space located between the three insulated electrical conductors permits a fluid to flow through the electrical cable.

45. The electrical cable or process according to any one of examples 1 to 44, wherein the metallic strands comprise copper strands, aluminum strands, or copper-clad aluminum strands.

46. The electrical cable or process according to any one of examples 1 to 45, wherein the metallic layer comprises copper, aluminum, copper-clad aluminum, austenitic nickel-chromium based alloys, nickel-iron-chromium based alloys, stainless steel, or carbon steel.

47. The electrical cable or process according to any one of examples 1 to 46, wherein the metallic elements comprise metallic rods.

48. The electrical cable or process according to any one of examples 1 to 46, wherein the metallic elements comprise metallic tubes.

49. The electrical cable or process according to any one of examples 1 to 46, wherein the metallic elements comprise one or more metallic tubes, and wherein one or more electrical conductors, one or more optical fibers, or a combination thereof is disposed within the one or more metallic tubes.

50. The electrical cable or process according to any one of examples 1 to 46, wherein the metallic elements comprise at least one metallic tube configured to convey a fluid therethrough.

51. The electrical cable or process according to examples 50, wherein the fluid comprises hydraulic fluid.

52. The electrical cable or process according to any one of examples 1 to 46, wherein the metallic elements comprise one or more metallic rods and one or more metallic tubes.

53. The electrical cable or process according to any one of examples 1 to 52, wherein the layer of electrically insulating material comprises a thermoset polymer, a thermoplastic polymer, or a combination thereof.

54. The electrical cable or process according to any one of examples 1 to 52, wherein the layer of electrically insulating material comprises polyethylene, polyurethane, rubber, crosslinked polyethylene, polyvinyl chloride, polytetrafluoroethylene, ethylene tetrafluoroethylene, tetrafluoroethylene, fluorinated ethylene propylene, a polyimide, modified ethylene tetrafluoroethylene, cresyl phthalate, wax, a polyetherketone, a polyether ether ketone, a polyaryletherketone, or a combination thereof.

55. The electrical cable or process according to any one of examples 1 to 52, wherein the layer of electrically insulating material comprises a rubber, and wherein the rubber comprises a thermoplastic rubber, neoprene, styrene butadiene rubber, silicone, natural rubber, ethylene propylene diene monomer, ethylene propylene rubber, chlorosulfonated polyethylene, or a combination thereof.

56. The electrical cable or process according to any one of examples 1 to 52, wherein the layer of electrically insulating material comprises a thermoset polymer, a thermoplastic polymer, paper, fiberglass, or a combination thereof.

57. The electrical cable or process according to any one of examples 1 to 56, wherein the electrically conductive core comprises copper, aluminum, or copper-clad aluminum.

58. The electrical cable or process according to any one of examples 1 to 56, wherein the electrically conductive core comprises one or more electrically conducting polymers.

59. The electrical cable or process according to any one of examples 1 to 56, wherein the electrically conductive core comprises a metal, an electrically conducting polymer, or a combination thereof.

60. The electrical cable or process according to any one of examples 1 to 59, wherein the metallic elements are sized to provide a gap between the metallic layer and the three insulated electrical conductors.

61. The electrical cable or process according to any one of examples 1 to 59, wherein the metallic layer is in direct contact with the metallic elements and a gap is present between the metallic layer and the three insulated electrical conductors.

62. The electrical cable or process according to any one of examples 1 to 61, wherein the metallic layer comprises a welded seam.

63. The electrical cable or process according to any one of examples 1 to 62, further comprising a core element disposed within an interstitial space located between the three insulated electrical conductors.

64. The electrical cable or process according to any one of examples 1 to 62, further comprising a core element disposed within an interstitial space located between the three insulated electrical conductors, and wherein the core element comprises a fiber optic cable.

65. The process according to any one of examples 3, 4, and 7 to 64, further comprising pressure testing the electrical cable to determine if a defect in the metallic layer is present by introducing a fluid at an elevated pressure into an open interstitial space located between the three insulated electrical conductors and the metallic layer.

66. The process according to any one of examples 3, 4, and 7 to 64, further comprising pressure testing the electrical cable to determine if a defect in the metallic layer is present by introducing a fluid at an elevated pressure into an open interstitial space located between the three insulated electrical conductors.

67. The process according to any one of examples 3, 4, and 7 to 64, further comprising pressure testing the electrical cable to determine if a defect in the metallic layer is present by introducing a fluid at an elevated pressure into an open interstitial space located between the three insulated electrical conductors and the metallic layer and an open interstitial space located between the three insulated electrical conductors.

68. The electrical cable or process according to any one of examples 1 to 67, wherein at least one of the metallic elements has a cross-sectional shape that substantially corresponds to a cross-sectional shape of the interstitial space the metallic element partially fills.

69. An electrical cable, comprising: at least one insulated electrical conductor and one or more metallic elements cabled together; and a metallic layer disposed about the at least one insulated electrical conductor and one or more metallic elements, wherein the one or more metallic elements partially fill a space located between the a least one insulated electrical conductor and the metallic layer, and wherein the at least one insulated electrical conductor comprises: an electrically conductive core; a layer of electrically insulating material disposed about the electrically conductive core; and a layer of metallic strands disposed about the layer of electrically insulating material.

70. A process for making a cable, comprising: cabling at least one insulated electrical conductor and one or more metallic elements together; seam welding a metallic layer about the at least one insulated electrical conductor and the one or more metallic elements, wherein the one or more metallic elements partially fill a space located between the at least one insulated electrical conductor and the metallic layer, and wherein the at least one insulated electrical conductor comprises: an electrically conductive core; a layer of electrically insulating material disposed about the electrically conductive core; and a layer of metallic strands disposed about the layer of electrically insulating material; and drawing down the metallic layer about the at least one insulated electrical conductor and the one or more metallic elements to produce an electrical cable.

71. An electrical cable connected to a wellbore tool for providing electrical power to the wellbore tool, comprising: at least one insulated electrical conductor and one or more metallic elements cabled together; and a metallic layer disposed about the at least one insulated electrical conductor and the one or more metallic elements, wherein the one or more metallic elements partially fill a space located between the at least one insulated electrical conductor and the metallic layer, and wherein the at least one insulated electrical conductor comprises: an electrically conductive core; a layer of electrically insulating material disposed about the electrically conductive core; and a layer of metallic strands disposed about the layer of electrically insulating material; and wherein the electrically conductive core is electrically connected to the wellbore tool.

72. The electrical cable or process according to any one of examples 69 to 71, wherein the layer of metallic strands is in direct contact with the metallic layer.

73. The electrical cable or process according to any one of examples 69 to 71, wherein the at least one insulated electrical conductor further comprises a layer of heat diffusing tape disposed about the layer of metallic strands, and wherein the layer of heat diffusing tape is in direct contact with the metallic layer.

74. The electrical cable or process according to any one of examples 69 to 71, wherein the at least one insulated electrical conductor further comprises a metallic sleeve disposed about the metallic strands, and wherein the metallic sleeve is in direct contact with the metallic layer.

75. The electrical cable or process according to examples 74, further comprising a layer of heat diffusing tape disposed between the metallic strands and the metallic sleeve.

76. The electrical cable or process according to any one of examples 69 to 75, wherein the at least one insulated electrical conductor further comprises a layer of polymer material disposed between the layer of electrically insulating material and the layer of metallic strands.

77. The electrical cable or process according to any one of examples 69 to 75, wherein the at least one insulated electrical conductor further comprises a layer of polymer material disposed between the layer of electrically insulating material and the layer of metallic strands and a layer of heat diffusing tape disposed about the layer of metallic strands, and wherein the layer of heat diffusing tape is in direct contact with the metallic layer.

78. The electrical cable or process according to any one of examples 69 to 75, wherein the at least one insulated electrical conductor further comprises a layer of polymer material disposed between the layer of electrically insulating material and the layer of metallic strands and a metallic sleeve disposed about the layer of metallic strands, and wherein the metallic sleeve is in direct contact with the metallic layer.

79. The electrical cable or process according to any one of examples 69 to 78, wherein an unfilled space permits a fluid to flow through the electrical cable.

80. The electrical cable or process according to any one of examples 69 to 79, wherein the one or more metallic elements comprise metallic rods, metallic tubes, or a combination thereof.

81 The electrical cable or process according to any one of examples 69 to 80, wherein the one or more metallic elements comprise one or more metallic tubes, and wherein one or more electrical conductors, one or more optical fibers, or a combination thereof is disposed within the one or more metallic tubes.

82. The electrical cable or process according to any one of examples 69 to 81, wherein the one or more metallic elements comprise at least one metallic tube configured to convey a fluid therethrough.

83. The electrical cable or process according to any one of examples 69 to 82, wherein the one or more metallic elements comprise one or more metallic rods and one or more metallic tubes.

84. The electrical cable or process according to any one of examples 69 to 83, wherein the metallic layer is in direct contact with at least one of the one or more metallic elements and a gap is present between the metallic layer and the at least one insulated electrical conductor.

85. The electrical cable or process according to any one of examples 69 to 84, wherein the metallic layer comprises a welded seam.

86. The process according to any one of examples 70 and 72 to 85, further comprising pressure testing the electrical cable to determine if a defect in the metallic layer is present by introducing a fluid at an elevated pressure into the space located between the at least one insulated electrical conductor and the metallic layer.

87. The electrical cable or process according to any one of examples 76 to 86, wherein the layer of polymer material comprises a thermoset polymer, a thermoplastic polymer, or a combination thereof.

88. The electrical cable or process according to any one of examples 76 to 86, wherein the layer of polymer material comprises polyethylene, polyurethane, rubber, crosslinked polyethylene, polyvinyl chloride, polytetrafluoroethylene, ethylene tetrafluoroethylene, tetrafluoroethylene, fluorinated ethylene propylene, a polyimide, modified ethylene tetrafluoroethylene, cresyl phthalate, wax, a polyetherketone, a polyether ether ketone, a polyaryletherketone, or a combination thereof.

89. The electrical cable or process according to any one of examples 76 to 86, wherein the layer of polymer material comprises a rubber, and wherein the rubber comprises a thermoplastic rubber, neoprene, styrene butadiene rubber, silicone, natural rubber, ethylene propylene diene monomer, ethylene propylene rubber, chlorosulfonated polyethylene, or a combination thereof.

90. The electrical cable or process according to any one of examples 76 to 86, wherein the layer of polymer material comprises an electrically semiconductive polymer, an electrically conductive polymer, an electrically non-conductive polymer, or any combination thereof.

91. The electrical cable or process according to any one of examples 76 to 86, wherein the layer of polymer material comprises an electrically semiconductive polymer.

92. The electrical cable or process according to any one of examples 76 to 86, wherein the layer of polymer material comprises an electrically conductive polymer.

93. The electrical cable or process according to any one of examples 76 to 86, wherein the layer of polymer material comprises an electrically non-conductive polymer.

94. The electrical cable or process according to any one of examples 76 to 93, wherein the at least one insulated electrical conductor comprises a single insulated electrical conductor.

95. The electrical cable or process according to any one of examples 76 to 93, wherein the at least one insulated electrical conductor comprises two insulated electrical conductors.

96. The electrical cable or process according to any one of examples 76 to 93, wherein the at least one insulated electrical conductor comprises greater than one insulated electrical conductor and less than three insulated electrical conductors.

97. The electrical cable or process according to any one of examples 76 to 93, wherein the at least one insulated electrical conductor comprises three insulated electrical conductors.

98. The electrical cable or process according to any one of examples 76 to 93, wherein the at least one insulated electrical conductor comprises four insulated electrical conductors.

99. The electrical cable or process according to any one of examples 76 to 93, wherein the at least one insulated electrical conductor comprises five insulated electrical conductors.

100. The electrical cable or process according to any one of examples 76 to 93, wherein the at least one insulated electrical conductor comprises six insulated electrical conductors.

101. The electrical cable or process according to any one of examples 1 to 100, wherein the electrical cable comprises 1 metallic element to about 50 metallic elements.

Although the preceding description has been described herein with reference to particular means, materials, and embodiments, it is not intended to be limited to the particulars disclosed herein; rather, it extends to all functionally equivalent structures, processes, and uses, such as are within the scope of the appended claims.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A process for making a cable, comprising:

cabling three insulated electrical conductors and metallic elements together;

centrally disposing one or more core elements between the three insulated electrical conductors, wherein the core elements partially fill an interstitial space located between the three insulated electrical conductors;

seam welding a metallic layer about the three insulated electrical conductors and the metallic elements, wherein the metallic elements partially fill an interstitial space located between the three insulated electrical conductors and the metallic layer, and wherein the three insulated electrical conductors each comprise:

an electrically conductive core;

a layer of electrically insulating material disposed about the electrically conductive core; and a layer of metallic strands disposed about the layer of electrically insulating material; and drawing down the metallic layer about the three insulated electrical conductors and the metallic elements to produce an electrical cable.

2. The process of claim 1, further comprising pressure testing the electrical cable to determine if a defect in the metallic layer is present by introducing a fluid at an elevated pressure into the interstitial space located between the three insulated electrical conductors and the metallic layer.

3. The process of claim 1, wherein at least one of the three insulated electrical conductors further comprises a metallic sleeve disposed about the layer of metallic strands, and wherein the metallic sleeve is in direct contact with the metallic layer.

4. The process of claim 1, further comprising pressure testing the electrical cable to determine if a defect in the metallic layer is present by introducing a fluid at an elevated pressure into an interstitial space located between the three insulated electrical conductors.

5. The process of claim 1, further comprising pressure testing the electrical cable to determine if a defect in the metallic layer is present by introducing a fluid at an elevated pressure into an open interstitial space located between the three insulated electrical conductors and the metallic layer and the interstitial space located between the three insulated electrical conductors.

6. The process of claim 1, wherein each layer of metallic strands is in direct contact with the metallic layer.

7. The process of claim 1, wherein at least one of the three insulated electrical conductors further comprises a layer of heat diffusing tape disposed about the layer of metallic strands, and wherein the layer of heat diffusing tape is in direct contact with the metallic layer.

8. The process of claim 1, wherein at least one of the three insulated electrical conductors further comprises a metallic sleeve disposed about the metallic strands, and wherein the metallic sleeve is in direct contact with the metallic layer.

* * * * *